US007900279B2

(12) United States Patent
Kraemer et al.

(10) Patent No.: US 7,900,279 B2
(45) Date of Patent: Mar. 8, 2011

(54) SPORTS HELMET WITH CLAMP FOR SECURING A CHIN PROTECTOR

(75) Inventors: Nelson Kraemer, Mt. Prospect, IL (US); Ralph J. Infusino, Bloomingdale, IL (US); Thad M. Ide, Chicago, IL (US)

(73) Assignee: Riddell, Inc., Rosemont, IL (US)

( * ) Notice: Subject to any disclaimer, the term of this patent is extended or adjusted under 35 U.S.C. 154(b) by 1098 days.

(21) Appl. No.: 11/517,811

(22) Filed: Sep. 8, 2006

(65) Prior Publication Data

US 2008/0092277 A1 Apr. 24, 2008

(51) Int. Cl.
*A63B 71/10* (2006.01)
*A42B 7/00* (2006.01)
*A42B 1/06* (2006.01)

(52) U.S. Cl. ..... 2/425; 2/421; 2/410

(58) Field of Classification Search ..... 2/410, 6.2, 2/417, 421, 422, 425, 336, 337, 338; 24/68 R, 24/68 A, 68 D, 70 ST, 69 TM, 71 ST, 265 R, 24/265 EC, DIG. 22, 69 ST
See application file for complete search history.

(56) References Cited

U.S. PATENT DOCUMENTS 1,262,818 A 4/1918 McGill
1,522,952 A 1/1925 Goldsmith
1,892,943 A 1/1933 Geyer
2,140,716 A 12/1938 Pryale (Continued)

FOREIGN PATENT DOCUMENTS

GB 1354719 5/1974

OTHER PUBLICATIONS

Newman, James A., "A Proposed New Biochemical Head Injury Assessment Function—The Maximum Power Index", Stapp Paper No. OOS-80, 44th Stapp Car Crash Conference Proceedings—Copyright 2000 The Staff Association; published prior to (critical date) Sep. 8, 2005. (Abstract only.).

(Continued)

*Primary Examiner* — Gary L Welch
*Assistant Examiner* — Amber R Anderson
(74) *Attorney, Agent, or Firm* — McDermott Will & Emery LLP

(57) ABSTRACT

The present invention is directed to a sports helmet with a clamp that secures an elongated strap of a chin protector assembly against the helmet. The clamp includes a main body having an opening, a finger and a receiver that is positioned between the opening and the finger. The clamp may also include a strengthening insert that extends longitudinally within the clamp. In a secured position, the main body is coupled to the helmet by both a fastener extending through the opening and the finger inserted into an aperture of the helmet. An extent of the chin strap is securedly positioned between the helmet and the receiver. In the secured position, an inner surface of the chin strap member is in contact with an outer surface of the helmet and an outer surface of the chin strap is in contact with the receiver. The receiver includes a plurality of gripping members that engage an outer surface of the chin strap in the secured position. Also, the receiver is recessed from an inner wall of the main body, whereby the receiver has a depth that corresponds to a thickness of the chin strap. Consequently, the receiver accepts the strap and the inner clamp wall makes contact with the helmet shell.

28 Claims, 3 Drawing Sheets

U.S. PATENT DOCUMENTS

| | | | | |
|---|---|---|---|---|
| 2,250,275 | A | | 7/1941 | Riddell |
| 2,867,811 | A | | 1/1959 | Jones |
| 3,166,761 | A | | 1/1965 | Elwood |
| 3,186,004 | A | | 6/1965 | Carlini |
| 3,187,342 | A | | 6/1965 | Aileo |
| 3,263,236 | A | | 8/1966 | Humphrey |
| 3,274,613 | A | | 9/1966 | Sowle |
| 3,327,313 | A | | 6/1967 | Pukish |
| 3,609,764 | A | | 10/1971 | Morgan |
| 3,619,813 | A | | 11/1971 | Marchello |
| 3,713,640 | A | | 1/1973 | Margan |
| 3,761,959 | A | | 10/1973 | Dunning |
| 3,787,895 | A | | 1/1974 | Belvedere |
| 3,854,146 | A | | 12/1974 | Dunning |
| 3,882,547 | A | | 5/1975 | Morgan |
| 3,916,446 | A | | 11/1975 | Gooding |
| 4,028,743 | A | | 6/1977 | Christensen |
| 4,044,400 | A | | 8/1977 | Lewicki |
| 4,075,714 | A | | 2/1978 | Ryder et al. |
| 4,233,687 | A | | 11/1980 | Lancellotti |
| 4,287,613 | A | | 9/1981 | Schulz |
| D267,287 | S | | 12/1982 | Gooding |
| 4,363,140 | A | | 12/1982 | Correale |
| 4,370,759 | A | | 2/1983 | Zide |
| 4,390,995 | A | | 7/1983 | Walck |
| 4,398,306 | A | * | 8/1983 | Gooding ..... 2/421 |
| 4,404,690 | A | | 9/1983 | Farquharson |
| 4,461,044 | A | | 7/1984 | Reiterman |
| 4,646,368 | A | | 3/1987 | Infusino et al. |
| 4,651,356 | A | | 3/1987 | Zide |
| 4,692,947 | A | * | 9/1987 | Black et al. ..... 2/421 |
| 4,741,054 | A | | 5/1988 | Mattes |
| 4,744,107 | A | | 5/1988 | Fohl |
| 4,774,729 | A | | 10/1988 | Coates et al. |
| 4,794,652 | A | | 1/1989 | Piech von Planta et al. |
| 4,831,668 | A | | 5/1989 | Schulz |
| 4,837,866 | A | | 6/1989 | Rector et al. |
| 4,853,980 | A | | 8/1989 | Zarotti |
| 4,903,346 | A | | 2/1990 | Reddemann et al. |
| 4,916,759 | A | | 4/1990 | Arai |
| 4,947,490 | A | | 8/1990 | Hayden |
| 5,014,365 | A | | 5/1991 | Schulz |
| 5,035,009 | A | | 7/1991 | Wingo et al. |
| 5,175,889 | A | | 1/1993 | Infusio |
| 5,177,816 | A | | 1/1993 | Schmidt et al. |
| 5,263,203 | A | | 11/1993 | Kraemer et al. |
| 5,267,353 | A | | 12/1993 | Milligan |
| 5,293,649 | A | | 3/1994 | Corpus |
| 5,347,660 | A | | 9/1994 | Zide et al. |
| D364,487 | S | | 11/1995 | Tutton et al. |
| 5,502,843 | A | * | 4/1996 | Strickland ..... 2/424 |
| 5,732,414 | A | | 3/1998 | Monica |
| 5,794,274 | A | | 8/1998 | Kraemer |
| 5,963,990 | A | | 10/1999 | White |
| 6,079,053 | A | | 6/2000 | Clover et al. |
| 6,081,932 | A | | 7/2000 | Kraemer |
| 6,189,156 | B1 | | 2/2001 | Loiars |
| 6,219,850 | B1 | | 4/2001 | Halstead et al. |
| 6,226,801 | B1 | | 5/2001 | Alexander et al. |
| 6,298,497 | B1 | | 10/2001 | Chartrand |
| 6,370,699 | B1 | | 4/2002 | Halstead et al. |
| 6,438,762 | B1 | | 8/2002 | Jenkins |
| D465,067 | S | | 10/2002 | Ide et al. |
| 6,481,024 | B1 | | 11/2002 | Grant |
| D475,486 | S | | 6/2003 | Ide et al. |
| 6,826,509 | B2 | | 11/2004 | Crisco, III et al. |
| 7,146,652 | B2 | | 12/2006 | Ide et al. |
| 2002/0104533 | A1 | | 8/2002 | Kalhok et al. |
| 2004/0025231 | A1 | | 2/2004 | Ide et al. |

OTHER PUBLICATIONS

Newman, James, "A New Biochemical Assessment of Mild Traumatic Brain Injury Part 2-Results and Communications"; published prior to (critical date) Sep. 8, 2005. (Abstract only.).

Newman, James, "A New Biochemical Assessment of Mild Traumatic Brain Injury Part 1—Methodology"; published prior to (critical date) Sep. 8, 2005. (Abstract only.).

* cited by examiner

SPORTS HELMET WITH CLAMP FOR SECURING A CHIN PROTECTOR

CROSS-REFERENCE TO RELATED APPLICATIONS

N/A

FEDERALLY SPONSORED RESEARCH OR DEVELOPMENT

N/A

TECHNICAL FIELD

The invention relates to a sports helmet with a clamp that secures a strap of a chin protector assembly against the helmet. More specifically, the invention provides a clamp with an embedded insert and a receiver that engages and secures the chin strap against an outer surface of the helmet.

BACKGROUND OF THE INVENTION

Helmets for contact sports, such as those used in football, hockey and lacrosse, typically include a chin protector that removably secures the helmet on the wearer's head. Chin protectors include a central portion, such as a protective cup, that engages the wearer's chin and at least one elongated strap member extending outward from each side of the cup. Conventional chin protectors are detachable from the helmet to allow for easy removal of the helmet, and for maintenance of the chin strap itself. Typically, a two-piece snap connector is used to connect each end of the chin strap to the helmet. The two-piece snap connector includes a male or stem portion of the snap that is affixed to and extends outward from the helmet, and a female or cap portion of the snap that is affixed via a buckle to the elongated strap member. An extent of the strap member is fed through the buckle and the cap is mounted to a central portion of the buckle. One conventional chin protector includes a pair of elongated strap members extending outward from opposed sides of the central cup, wherein each strap member bears a female portion of the snap. Each side of the helmet includes a pair of male snap portions, wherein each male snap portion mates with a female snap portion of the chin strap for securement of the helmet on the wearer's head. An example of an existing chin strap for a sports helmet is disclosed in U.S. Pat. No. 6,081,932 to Kraemer.

Some modern sports helmets position a first male snap or stem at a mid-height of the shell near the shell's frontal opening and a second stem along a lower edge of the shell. Thus, the helmet includes a stem at each upper end of the frontal opening and a stem along the lower shell edge of each ear flap. While such conventional chin straps provide some benefits, they nevertheless have certain limitations. For example, opposing players may strike the buckle during the course of play, where repeated striking may damage the buckle and/or disengage the buckle and cap from the stem. The present invention is provided to solve these limitations and to provide advantages and aspects not provided by conventional chin strap connectors used with sports helmets. A full discussion of the features and advantages of the present invention is deferred to the following detailed description, which proceeds with reference to the accompanying drawings.

SUMMARY OF THE INVENTION

The present invention is directed to a sports helmet having a chin protector assembly and a clamp for securing a chin strap against the helmet. The clamp features a main body with an embedded insert, a finger that is received by an aperture in the helmet, and a receiver that engages and secures the strap against an outer surface of the helmet. The chin strap removably connects the helmet to the wearer's head. The chin strap includes a central protective cup for the wearer's chin and at least one flexible strap member extending from opposed sides of the cup.

According to another aspect of the invention, the main body of the clamp has a substantially rectangular configuration with opposed rounded ends and a curvilinear outer wall arrangement. Further, the main body has an inner wall that is preferably curvilinear to match the curve of the outer surface of the shell which facilitates flush engagement between the clamp and the shell. The main body also includes an opening configured to receive an elongated fastener that extends through the opening and into the shell. The finger extends from the inner wall of the main body and includes a stub portion, a tip portion and a curvilinear intermediate portion. Preferably, the finger is configured such that the tip portion extends beyond the end of the main body.

According to another aspect of the invention, the receiver engages and secures an extent of the strap against an outer surface of the shell. The receiver is recessed from the inner wall to define a cavity that receives an extent of the strap and that is positioned between the opening and the finger. The cavity preferably has a depth that corresponds to a thickness of the strap such that the strap does not extend beyond the cavity or past the inner wall. The receiver also includes a plurality of gripping members that engage an outer surface of the strap. The insert is embedded within the main body and extends longitudinally between the opening and the finger. The insert has a first end with a projection that extends into the finger, and a second end that extends into the opening In a secured position, an extent of the upper chin strap is securedly positioned between the helmet shell and the receiver. Thus, an inner surface of the strap is in contact with an outer surface of the helmet shell, and an outer surface of the strap member is in contact with the receiver wherein the gripping members engage the outer surface. In this manner, the strap member is "sandwiched" between the clamp, primarily the receiver, and the helmet shell. The fastener extends through the opening in the main body and through the helmet shell. The fastener contacts the second insert end that extends into the opening and exerts a force upon the second end. The finger is received by an aperture in the shell to couple the end of the clamp opposite the opening to the shell. Also in the secured position, the gripping members rigidly engage the strap member, namely the outer surface, to prevent it from slipping within the receiver. Thus, the engagement between the gripping members and the outer surface of the strap member maintains the desired position and tension of the chin protector assembly and prevents unintended loosening of the chin protector Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
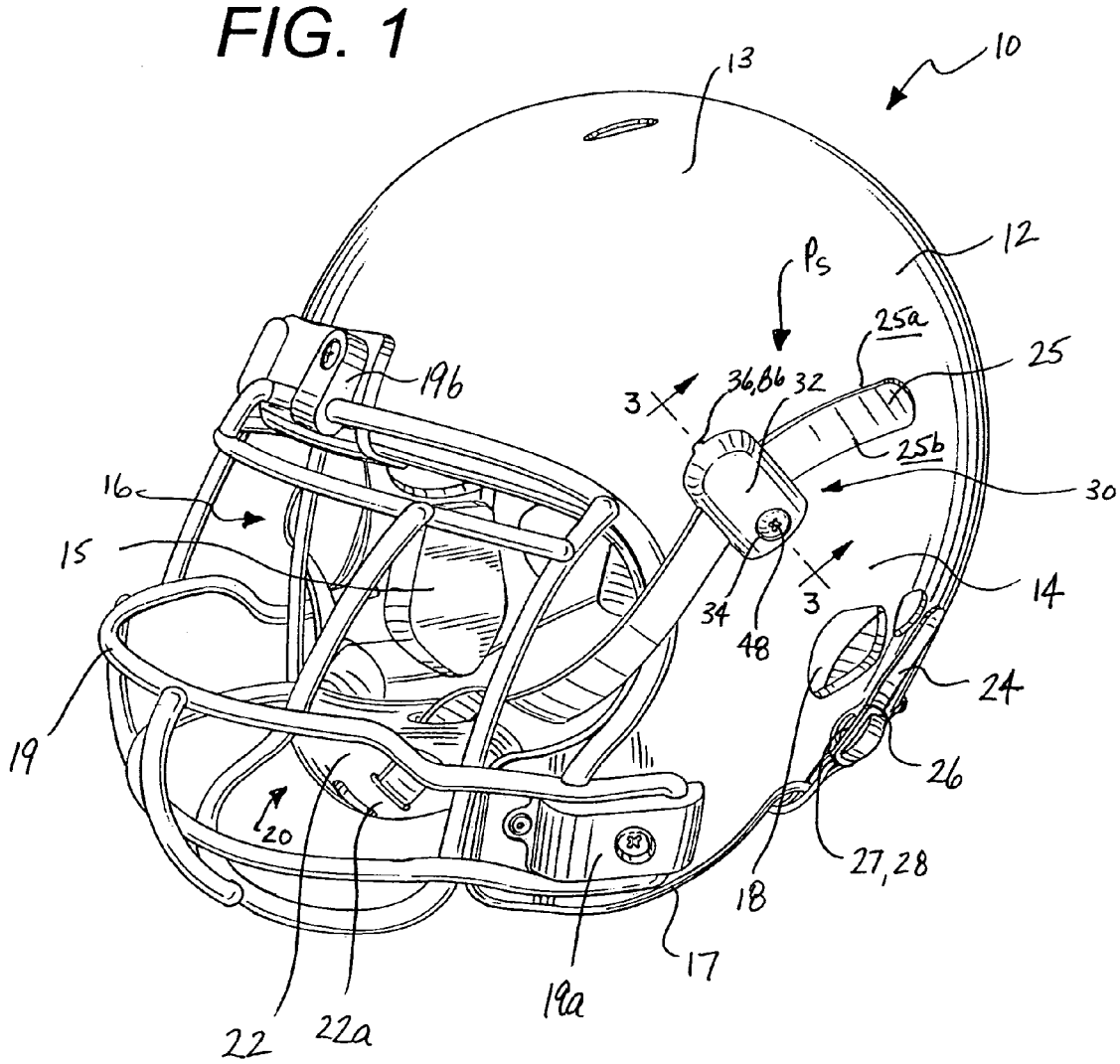
FIG. 1 is a perspective view of a sports helmet of the present invention, showing a chin strap and a clamp in a secured position.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-5 provide a sports helmet 10 and clamp 30 of the invention. Although shown as a football helmet, the helmet 10 may be one suitable for use in other sports requiring head protections, such as hockey or lacrosse. The helmet 10 comprises a shell 12, a pair of ear flaps 14 depending from a crown or top portion 13 of the shell 12, a frontal opening 16, and an ear opening 18 in each ear flap 14. Each ear flap 14 is configured to overlie the wearer's ear, while the frontal opening 16 provides an aperture through which the wearer looks while participating in the related sporting activity. The shell 12 is preferably fabricated from a plastic material having the requisite strength and durability characteristics to function as a sports helmet. The shell 12 also has a peripheral edge 17 that is continuous about the periphery of the shell 12. As a result, the edge 17 defines the boundary of the frontal opening 16 and the lower boundary of the ear flaps 14.

Additionally, the helmet 10 includes a face guard or mask 19 fixedly secured to the shell 12 by connectors 19*a* near the ear flap 14 and connectors 19*b* near an upper region of the frontal opening 16. The face guard 19 includes a plurality of intersecting and elongated members that are configured to protect the wearer's face from blows during the sporting activity. The helmet 10 also includes an interior padding assembly 15, which may be removably connected to an inner surface of the shell 12.

A chin protector assembly 20 is utilized to removably connect the helmet 10 to the wearer's head. The chin protector assembly 20 includes a central portion, such as a protective cup 22 that receives the wearer's chin and at least one flexible strap member 24 extending from opposed sides of the cup 22. Accordingly, the chin protector assembly 20 includes a first strap member 24 associated with a left ear flap 14 and a second strap member 24 associated with a right ear flap 14. The cup 22 may include a slot 22*a* that receives a portion of the strap member 24 and an inner padding element (not shown). In the embodiment of FIG. 1, the chin protector assembly 20 includes two straps 24, 25 extending from each side of the cup 22—a lower strap member 24 and an upper strap member 25. Thus, the chin protector assembly 20 includes a total of four strap members 24, 25 that are connected to the shell 12. To connect to the shell 12, the lower strap member 24 utilizes a conventional two-piece snap connector, including a buckle 26 with a cap 27 that couples with a male or stem portion 28 extending from the shell 12.

The upper strap member 25 is secured to the shell 12, preferably at an upper portion of the shell 12 near the frontal opening 16, by the clamp 30. As shown in FIGS. 2-5, the clamp 30 includes a main body portion 32 with an opening 34, a finger 36 and a receiver 38 positioned between the opening 34 and the finger 36. As explained in greater detail below, the receiver 38 engages and secures an extent of the upper strap 25 against an outer surface of the shell 12. In one embodiment, the main body 32 further includes an insert 40 (see FIGS. 3-5) longitudinally embedded within the main body 32, wherein the insert 40 is adapted to increase the rigidity and durability of the clamp 30. The main body 32 has a substantially rectangular configuration with opposed rounded ends 42 and a curvilinear outer wall arrangement 44 that precludes pointed or sharp surfaces. Further, the main body 32 has an inner wall 46 that is preferably curvilinear to match the curve of the outer surface of the shell 12 which facilitates flush engagement between the clamp 30 and the shell 12. Thus, the inner wall 46 has a radius of curvature that corresponds to the radius of curvature of the helmet shell 12 where the clamp 30 is secured against.

Figure 3:
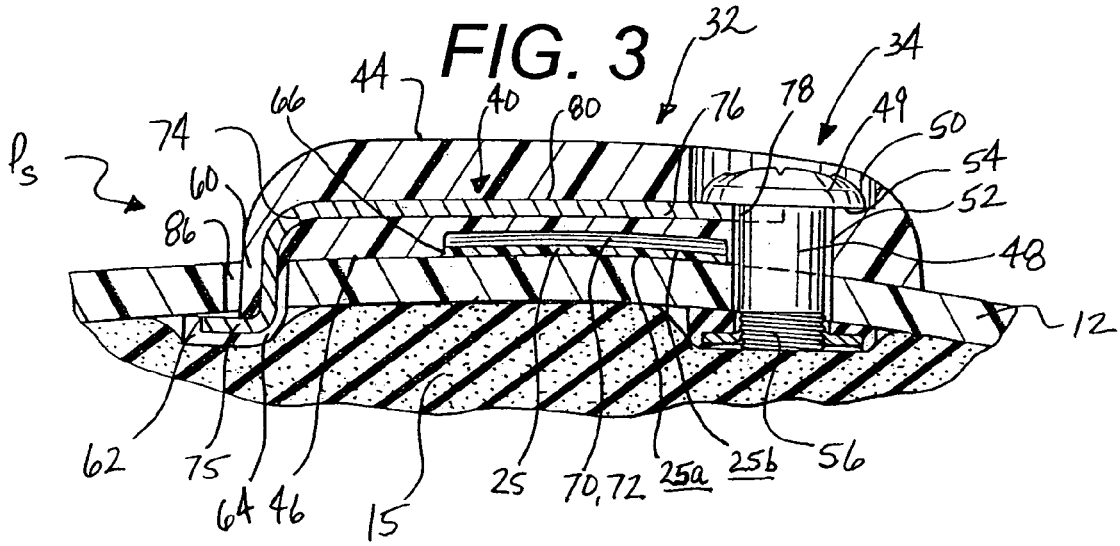
FIG. 3 is a cross-section of the helmet and clamp taken along line 3-3 of FIG. 1 in the secured position.

Referring to FIGS. 1 and 3, the opening 34 is configured to receive an elongated fastener 48 that extends through the opening 34 and into the shell 12. Preferably, the opening 34 comprises a first passageway 50 (see FIG. 3) with a first diameter and a second passageway 52 with a second diameter, wherein the first diameter exceeds the second diameter thereby forming a notch 54 between the first and second passageways 50, 52. The upper portion or head 49 of the fastener 48 engages the notch 54 and resides within the first passageway 50. In this manner, the head 49 resides either flush with or within the outer wall 44. A locking element or nut 56, including one with a sleeve that receives an extent of the fastener 48, may be positioned within the shell 12 to stabilize the fastener 48 and the clamp 30. The finger 36 extends from the inner wall 46 of the main body 32 and includes a stub portion 60, a tip portion 62 and a curvilinear intermediate portion 64. Preferably, the finger 36 is configured such that the tip portion 62 extends beyond the end 42 of the main body 32. Alternatively, the finger 36 is positioned inward of the end 42 such that the tip 62 resides inward of the end 42.

Figure 2:
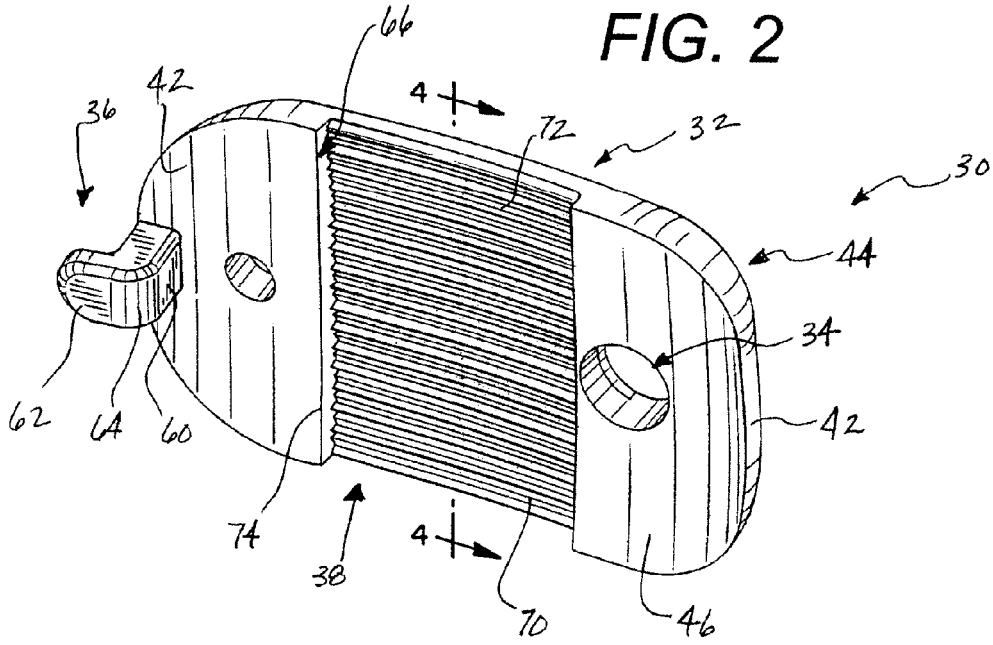
FIG. 2 is a perspective view of the clamp, showing an underside of the clamp.
Figure 2A:
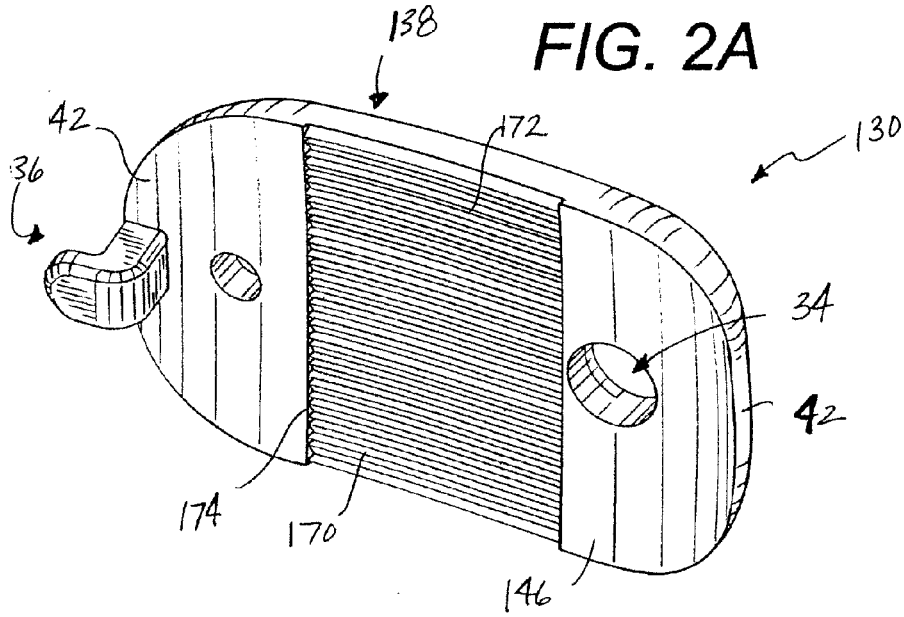
FIG. 2A is a perspective view of an alternate clamp, showing an underside of the clamp.

As mentioned above, the receiver 38 engages an extent of the upper strap 25 for securement against the shell 12. In one embodiment, the receiver 38 is recessed from the inner wall 46 to define a cavity 66 that receives an extent of the strap 25 and that is positioned between the opening 34 and the finger 36. Thus, the receiver 38 has a "U-shaped" configuration in profile and is in communication with the inner wall 46. Referring to FIG. 3, the cavity 66 preferably has a depth that corresponds to a thickness of the strap 25 such that the strap 25 does not extend beyond the cavity 66 or past the inner wall 46. The receiver 38 also includes a plurality of gripping members 70 that engage an outer surface of the strap 25. The gripping members 70 can be teeth 72 that are formed from angled walls that converge, wherein the teeth 72 are oriented substantially parallel to the longitudinal axis of the main body 32. Alternatively, the gripping members 70 are raised bumps or waves (not shown) adapted to engage the strap 25. An alternate embodiment of the clamp 130 is shown in FIG. 2A. There, the clamp 130 includes gripping members 170 with teeth 172 having a height that preferably terminates inward of the edge 174 between the inner wall 146 and the receiver 138. The receiver 138 is aligned or flush with the inner wall 146 thereby precluding the recessed cavity 66 described above. As a result, the gripping members 170, such as the teeth 172, reside in the same plane as the inner wall 146 and do not extend past the inner wall 146.

In another embodiment of the clamp (not shown), the receiver is a slot internally located within the main body, instead of being recessed from the inner wall. Preferably, the receiver is positioned between the insert and the inner wall, and is separated from the inner wall by a band of material adjacent to the inner wall. The receiver has a first interior wall and a second interior wall that are substantially parallel to the inner wall and that are spaced a distance apart to define the slot. The first interior wall and/or the second interior wall have gripping members for engagement with the strap member 25 inserted into the receiver. In this configuration, the main body may be formed from two distinct segments, for example an upper segment and a lower segment, that are joined together to form the receiver. Continuing with this example, the lower segment can include the depending finger and the upper segment can include the reinforcing insert. The fastener 48 is utilized to couple the upper and lower segments of the clamp. This coupling exerts a force on the upper segment with respect to the lower segment that facilitates the engagement between the gripping members and the strap member 25.

Figure 4:
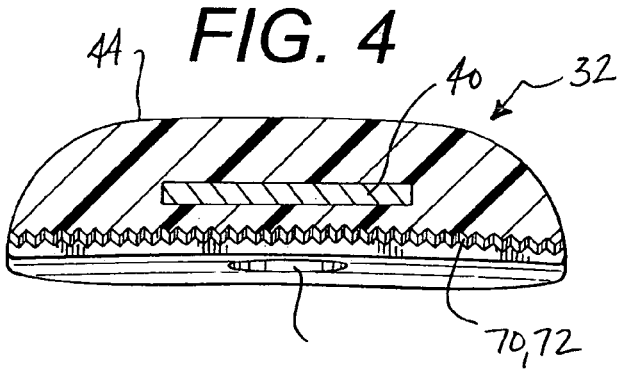
FIG. 4 is a cross-section of the clamp taken along line 4-4 of FIG. 2; and, FIG. 5 is a perspective view of an insert that is embedded within the clamp.
Figure 5:
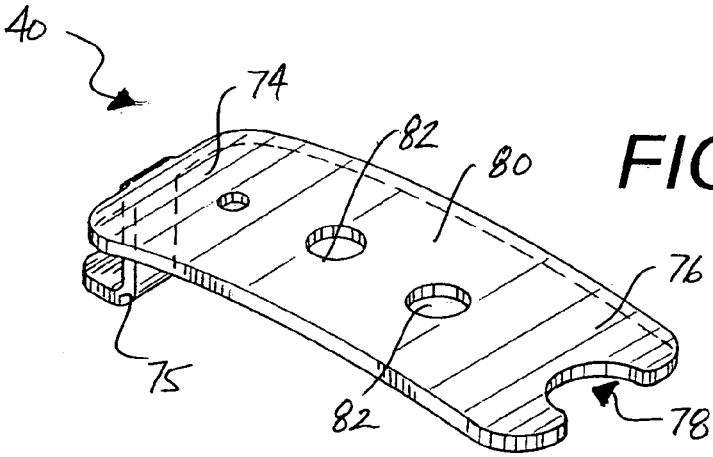

Referring to FIGS. 3-5, the insert 40 is embedded within the main body 32 and extends longitudinally between the opening 34 and the finger 36. Preferably, the insert 40 has a first end 74 with a projection 75 that extends into the finger 36 and terminates at the tip 62 of the finger 36. Also, the insert 40 has a second end 76 that extends into the opening 34. Preferably, the second end 76 has a curvilinear recess 78 that resides adjacent the notch 54. A main portion 80 of the insert 40 is positioned above the gripping members 70, while the projection 75 is positioned below the gripping members 70. The main portion 80 includes at least one hole 82 that facilitates insertion and alignment of the insert 40 within the main body 32. Since the insert 40 is adapted to increase the durability and integrity of the main body 32, the insert 40 is fabricated from metal, such as S45C steel, and may be heat treated and/or plated, such as with zinc. To ensure durability, the main body 32 is fabricated from a high strength plastic, such as polycarbonate resin.

FIGS. 1 and 3 show the clamp 30 in a secured position $P_S$ wherein an extent of the upper chin strap member 25 is securedly positioned between the helmet shell 12 and the receiver 38. In the secured position $P_S$, an inner surface 25*a* of the strap member 25 is in contact with an outer surface of the helmet shell 12, and an outer surface 25*b* of the strap member 25 is in contact with the receiver 38 wherein the gripping members 70 engage the outer surface 25*b*. In this manner, the strap member 25 is "sandwiched" between the clamp 30, primarily the receiver 38, and the helmet shell 12. Because the receiver 38 is recessed from the inner wall 46 of the main body 32 to accept the strap member 25, the strap 25 does not prevent the inner wall 42 from making contact with the shell 12. The fastener 48 extends through the opening 34 in the secured position $P_S$, wherein the fastener head 49 resides within the outer wall 44. Preferably, the opening 34 has the first and second passageways 50, 52 wherein the fastener head 49 engages the notch 54 and remains within the second passageway 52. Thus, the fastener head 49 does not protrude beyond the outer wall 44 of the clamp 30. In the embodiment where the clamp 30 includes the insert 40, the fastener 48 contacts the second end 76 that extends into the opening 34. Furthermore, the recess 78 of the second end 76 accommodates an extent of the fastener 48 such that the fastener head 49 exerts a force upon the second end 76 against the notch 54.

Also in the secured position $P_S$, the finger 36 is received by an aperture 86 in the shell 12 to couple the end of the clamp 30 opposite the opening 34 to the shell 12. Preferably, the tip 62 of the finger 36 is inserted into the aperture 86 and engages a lower surface of the shell 12, and the finger stub 60 resides within the aperture 86 (see FIG. 3). Although FIG. 1 shows the finger 36 positioned above the fastener 48 and the opening 34, the clamp 30 may be configured such that the finger 36 is below the opening 34. In the secured position $P_S$, the gripping members 70 rigidly engage the strap member 45, namely the outer surface 25*b*, to prevent it from slipping within the receiver 38. Thus, the engagement between the gripping members 70, for example the teeth 72 of FIG. 3, and the outer surface 25*b* of the strap member 25 maintains the desired position and tension of the chin protector assembly 20 and prevents unintended loosening of the protector assembly 20. In an embodiment where the helmet 10 includes two clamps 30, each clamp 30 secures a strap member 25 to the shell 12 near an upper portion of the frontal opening 16. Described in a different manner, each clamp 30 secures the strap member 25 to the shell 12 above the ear opening 18. In the secured position $P_S$, the clamp 30 provides a low-profile connection point for the strap member 25 against the helmet shell 12.

Unlike conventional chin guard connectors that feature two-piece snaps, the clamp 30 cannot be un-snapped to adjust and/or remove the strap member 25. To move from the secured position $P_S$ to an unsecured position which allows for adjustment and/or removal of the strap member 25, the fastener 48 is loosened to create a gap between the main body 32 and the helmet 10. This gap may result from pivotal movement of the clamp 30 about the finger 36. Once a sufficient gap is created, the gripping members 70 disengage the strap 25 which allows the user to slide the strap 25 past the clamp 30. Alternatively, the user can remove the fastener 48 and then disengage the finger 36 from the aperture 86 in the shell 12.

In another embodiment of the clamp (not shown), the main body 32 comprises a first connector and a second connector with the receiver 38 residing between the first and second connectors. The first or second connectors removably couple the clamp to the helmet shell 12 and comprise the elongated fastener 48 extending through the opening 34. Thus, the alternate clamp may include two fasteners 48 positioned about the receiver 38 for securement of the strap member 25 against the helmet shell 12.

While the specific embodiments have been illustrated and described, numerous modifications come to mind without significantly departing from the spirit of the invention, and the scope of protection is only limited by the scope of the accompanying Claims.

What is claimed is:

1. A clamp for securing a strap to a sports helmet, the apparatus comprising:

a main body having an integral opening and a finger that is inserted into an aperture of a helmet shell, the aperture located above a lower edge of the helmet shell, the main body also having a receiver that engages and secures a portion of the strap against an outer surface of the helmet shell.

2. The securing clamp of claim 1, wherein the clamp includes an insert embedded longitudinally within the main body.

3. The securing clamp of claim 2, wherein the insert extends between the finger and the opening.

4. The securing clamp of claim 1, wherein the opening is configured to receive an elongated fastener extending into the helmet shell to couple the main body directly to the helmet shell.

5. The securing clamp of claim 1, wherein the main body has an inner wall surface and the receiver is recessed from the inner wall surface to define a cavity, wherein the cavity receives an extent of the strap in a secured position.

6. The securing clamp of claim 5, wherein the inner wall surface has a curvilinear configuration that corresponds to the outer surface of the helmet shell where the main body is secured against the helmet shell.

7. The securing clamp of claim 1, wherein the receiver comprises a plurality of gripping members that engage an extent of the strap in a secured position.

8. The securing clamp of claim 7, wherein the gripping members comprise a plurality of teeth.

9. A clamp for securing a chin strap to a sports helmet having a shell, the clamp comprising:

a main body having an integral opening, a finger and a receiver, wherein the receiver is positioned between the opening and the finger; and, wherein in a secured position, the main body is coupled to the helmet shell by both a fastener extending through the opening and the finger inserted into an aperture of the helmet shell, and an extent of the chin strap is securedly positioned between the helmet shell and the receiver.

10. The securing clamp of claim 9, wherein clamp includes an insert embedded longitudinally within the main body.

11. The securing clamp of claim 9, wherein in the secured position, an inner surface of the chin strap is in contact with an outer surface of the helmet shell, and an outer surface of the chin strap is in contact with the receiver.

12. The securing clamp of claim 9, wherein the receiver includes a plurality of gripping members that engage an outer surface of the chin strap in the secured position.

13. The securing clamp of claim 9, wherein the receiver is recessed from an inner wall surface of the main body, whereby the receiver has a depth that corresponds to a thickness of the chin strap.

14. The securing clamp of claim 9, wherein the finger extends from an inner wall of the main body.

15. The securing clamp of claim 9, wherein a head of the fastener resides within an outer wall of the main body.

16. The securing clamp of claim 9, wherein the opening comprises a first passageway with a first diameter and a second passageway with a second diameter, wherein the first diameter exceed the second diameter thereby forming a notch between the first and second passageways.

17. A sports helmet comprising:

a shell configured to receive a head of a wearer of the helmet;

a chin strap having a central portion and at least one strap member outwardly extending from opposed sides of the central portion; and, a clamp having a main body having an integral opening, a finger and a receiver, wherein the receiver is positioned between the opening and the finger, wherein in a secured position, the main body is coupled to the helmet shell by both a fastener extending through the opening and the finger inserted into an aperture of the helmet shell;

wherein the strap member is positioned between the shell and the receiver of the clamp to secure the strap member to the shell.

18. The sports helmet of claim 17, wherein in the secured position, a fastener extends through the opening and into the shell to couple the clamp to the shell.

19. The sports helmet of claim 18, wherein in the secured position, the finger is received by an aperture in the shell to couple the clamp to the shell.

20. The sports helmet of claim 17, wherein the receiver is recessed from an inner wall of the clamp to define a cavity that receives an extent of the strap member in the secured position.

21. The sports helmet of claim 20, wherein the cavity includes a plurality of gripping members that engage an outer surface of the chin strap in the secured position.

22. The sports helmet of claim 17, wherein the shell has a frontal opening and the clamp secures the strap member to the shell near an upper portion of the frontal opening.

23. The sports helmet of claim 17, wherein the shell has an ear opening and the clamp secures the strap member to the shell above the ear opening.

24. A clamp for securing a chin strap to a sports helmet having a shell, the clamp comprising:

a main body having an integral opening, a finger and a receiver, wherein the receiver is positioned between the opening and the finger; and, wherein in a secured position, the main body is coupled to the helmet shell by both a fastener extending through the opening and the finger inserted into an aperture of the helmet shell, to collectively secure a portion of the strap against an outer surface of the helmet shell.

25. The securing clamp of claim 24, wherein in the secured position a longitudinal axis of the strap is substantially perpendicular to a longitudinal axis of the main body.

26. The securing clamp of claim 24, wherein the clamp includes an insert embedded longitudinally within the main body.

27. The securing clamp of claim 26, wherein the insert has a projection that resides within the finger.

28. The securing clamp of claim 24, wherein in the secured position, an inner surface of the chin strap is in contact with an outer surface of the helmet shell, and an outer surface of the chin strap is in contact with the receiver.

* * * * *